US007712157B2

(12) United States Patent
Laundre

(10) Patent No.: US 7,712,157 B2
(45) Date of Patent: May 11, 2010

(54) RELEASABLE TOILET SEAT ASSEMBLY

(75) Inventor: Jeffrey T. Laundre, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 508 days.

(21) Appl. No.: 11/800,372

(22) Filed: May 4, 2007

(65) Prior Publication Data

US 2008/0271230 A1 Nov. 6, 2008

(51) Int. Cl.
*A47K 13/12* (2006.01)

(52) U.S. Cl. ..... 4/236; 4/240

(58) Field of Classification Search ..... 4/234–241
See application file for complete search history.

(56) References Cited

U.S. PATENT DOCUMENTS

| | | | | | |
|---|---|---|---|---|---|
| 4,159,548 | A | | 7/1979 | Hewson | |
| 4,173,802 | A | * | 11/1979 | Wikstrom | 4/236 |
| 4,326,307 | A | | 4/1982 | Baillie et al. | |
| 4,438,535 | A | * | 3/1984 | Paredes | 4/234 |
| 4,479,273 | A | * | 10/1984 | Raden et al. | 4/236 |
| 4,939,796 | A | | 7/1990 | Pepper | |
| 4,965,889 | A | * | 10/1990 | Tissot et al. | 4/234 |
| 5,537,725 | A | | 7/1996 | Takahashi | |
| 5,933,875 | A | | 8/1999 | Hulsebus et al. | |
| 6,070,295 | A | | 6/2000 | Hulsebus | |
| 6,178,597 | B1 | | 1/2001 | Suzuki et al. | |
| 6,275,999 | B1 | | 8/2001 | Fujita | |
| 6,381,762 | B1 | | 5/2002 | Moser | |
| 6,421,842 | B1 | | 7/2002 | Fujita | |
| 6,807,686 | B1 | | 10/2004 | Janes | |
| 7,093,308 | B2 | * | 8/2006 | Berlovan et al. | 4/237 |
| 7,155,748 | B2 | * | 1/2007 | Vierkant et al. | 4/240 |
| 7,281,276 | B2 | * | 10/2007 | Vierkant et al. | 4/240 |
| 2005/0217008 | A1 | | 10/2005 | Vierkant, III et al. | |
| 2005/0217009 | A1 | | 10/2005 | Vierkant, III et al. | |
| 2008/0060120 | A1 | * | 3/2008 | Er | 4/236 |
| 2009/0106884 | A1 | * | 4/2009 | Bemis et al. | 4/236 |

FOREIGN PATENT DOCUMENTS

JP 2002095610 2/2002

OTHER PUBLICATIONS

PCT, International Search Report, Written Opinion, 9 pages.

* cited by examiner

*Primary Examiner*—Khoa D Huynh
(74) *Attorney, Agent, or Firm*—Quarles & Brady LLP

(57) ABSTRACT

An easy release hinge assembly for connecting a covering member to a toilet base is disclosed. It has a mounting plate mountable on an upper rearward surface of the toilet base, and having two spaced apart through holes and two overhanging lateral wings. Fasteners are extendible through the through holes and then through a portion of the toilet base to mount the mounting plate thereon. There is also a hinge base member adapted to support the covering member in a pivotal fashion, the hinge base member having a pair of spaced essentially horizontally extending extension arms defining in part an opening for receiving the mounting plate therebetween. A lid is pivotably mounted on the hinge base to pivot between a first position where a rearward portion of the lid is positioned behind the mounting plate, and a second position where it is not.

14 Claims, 8 Drawing Sheets

RELEASABLE TOILET SEAT ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to mounting toilet seats and/or covers to the top of toilet bowls. More particularly, it relates to assemblies that permit most of the assembly parts to be readily removed from the toilet to facilitate cleaning behind the bowl basin.

Typically, toilet seats and covers are sold pre-assembled with hinge posts. This subassembly is then affixed via hinge posts to a rearward extension of the toilet base behind the bowl. In such constructions the posts are typically bolted to the rearward extension using a bolt-like fastener that extends down through the extension. A nut threads onto the fastener from underneath the extension to clamp the assembly to the extension. These assemblies are intended to be essentially permanently affixed to the toilet base extension, particularly given that assembly and removal requires the application of tooling at the underside of the extension.

The area around such hinge posts (behind and under the cover and seat) can be difficult to clean thoroughly. Urine and other splashed contaminants can collect around the hinge posts, with the subsequent development of an undesirable appearance or smell, or unsanitary conditions.

There have been a number of attempts to develop toilet seat hinge assemblies where the seat and cover and associated pivot pins can be removed from the toilet relatively easily, and then (after cleaning) be relatively easily reconnected. See e.g. U.S. Pat. Nos. 4,159,548; 4,326,307; 4,939,796; 5,537,725; 5,933,875; 6,070,295; 6,381,762; 6,421,842, 6,807,686; and U.S. patent application Ser. Nos. 2005/0217008 and 2005/0217009. See also U.S. Pat. Nos. 6,178,597 and 6,275,999 for other hinge structures for controlling cover movement.

At least some of these systems facilitate cleaning behind the bowl by leaving only small posts essentially permanently affixed to the toilet base, while providing readily releasable subassemblies that can removably link up with these posts. However, these prior art systems have a variety of deficiencies.

Some rely on a relatively weak connection between the subassembly and base posts such that the subassembly can accidentally be knocked off the posts. Others rely on relatively weak parts which may have a high incidence of breakage over prolonged use. Still others require relatively complex multi-part assemblies, which increase the cost of production and may require some consumer training. Still other assemblies require tools for the disassembly for cleaning purposes. Yet others require a consumer to touch portions of the assembly that may be contaminated.

A need still exists for further improved toilet seat mounting assemblies, particularly those which use fewer parts and which more stably retain the toilet seat in place.

SUMMARY OF THE INVENTION

In one aspect the present invention provides a hinge assembly for connecting a covering member (e.g. a toilet seat and/or a toilet seat cover) to a toilet base. It has a mounting plate mountable on an upper rearward surface of the toilet base, and has two spaced apart through holes and two lateral wings. It also has fasteners extendible through the through holes and then through a portion of the toilet base to mount the mounting plate thereon, and a hinge base member adapted to support the covering member in a pivotal fashion, the hinge base member having a pair of essentially horizontally extending extension arms defining in part an opening for receiving the mounting plate therebetween.

There is a lid pivotably mounted on the hinge base to pivot between a first position where a rearward portion of the lid is positioned behind a portion of the mounting plate, and a second position where it is not. The arms of the hinge base member can be slid under the wings of the mounting plate so as to restrict upward movement of the hinge base member relative to the rearward extension of the toilet base. Also, when the lid is in the first position it can assist in restricting forward movement of the hinge base member relative to the mounting plate.

In a preferred form there is a recess on at least one of the hinge base member and lid and a projection on the other of the hinge base member and lid, such that as the lid pivots toward the first position the projection snaps into the recess to help inhibit movement of the lid from the first position. For example, the recess may be on the lid, and the projection may be at a rearward portion of a hinge base member arm.

In another form there is a recess on at least one of the hinge base member and mounting plate, and a projection on the other of the hinge base member and mounting plate, such that as the arms of the hinge base member slide under the wings of the mounting plate the projection snaps into the recess to help inhibit forward movement of the hinge base member relative to the mounting plate. For example, the recess may be on the mounting plate and the projection may be formed along a lateral surface of a hinge base arm.

A portion of the hinge base member may be formed of plastic, a metallic decorative shield can be positioned over that plastic portion, and the lid can be metallic. When installed on a toilet base, the assembly would then present an essentially decorative and wear resistant metallic appearance even though the internal connecting parts, can be made of a plastic.

A frontal portion of the lid may be formed with extensions that can hook between the metallic decorative shield and the plastic portion of the hinge base member. This creates a desirable assembling technique.

In other refinements the mounting plate has a narrowed central section and wide side lobes, and the lid is formed with a rearward end that has a forwardly dished recess for facilitating gripping the lid.

In a further alternative embodiment the arms of the hinge base member are capable of flexing away from each other, and rearward portions of the arms of the hinge base member are each formed as contoured catch finger portions. The mounting plate is then formed with a laterally directed bulge under each wing on which a catch finger can slide against and catch behind.

In another aspect the invention provides such a hinge assembly connecting such a covering member to such a toilet base.

Regardless of embodiment, the mounting plate can be essentially permanently mounted on an upper surface of a rearward extension of a toilet bowl. Then, a subassembly of the covering member(s) and hinge base member can be slid rearwardly such that rearwardly directed arms of the hinge base member catch under overhanging lateral wings of the mounting plate. This restricts upward movement of the hinge base member.

Then, one can pivot the lid down so that its rearward end drops behind the mounting plate. This restricts forward movement of the hinge base member.

When cleaning is desired one can pivot the lid up and then pull the covering member(s) and accompanying hinge base member forward. Re-assembly reverses these steps.

Thus, the present invention facilitates easy assembly as well as easy removal when cleaning is desired. Because the mounting plate is fastened at two points it resists any tendency of the cover to pull away from the mounting plate in an uncontrolled manner, or move out of alignment. Further, it simplifies installation compared to use of two separate mounting elements.

The assembly can either be an original equipment type product, or it can be used as a replacement toilet seat assembly as the hole positions on the mounting plate can be at standard distances apart previously used for multiple base member designs. Further, the present assembly is conceptually easy for a consumer to understand, and does not require advanced plumbing skills to install.

These and other advantages of the present invention will be apparent from the description below and the accompanying drawings. While preferred embodiments are described and depicted, it should be understood that these disclosures are not made by way of limitation. Rather, they merely show examples of broader principles.

DETAILED DESCRIPTION OF THE PREFERRED EMBODIMENT

Figure 1:
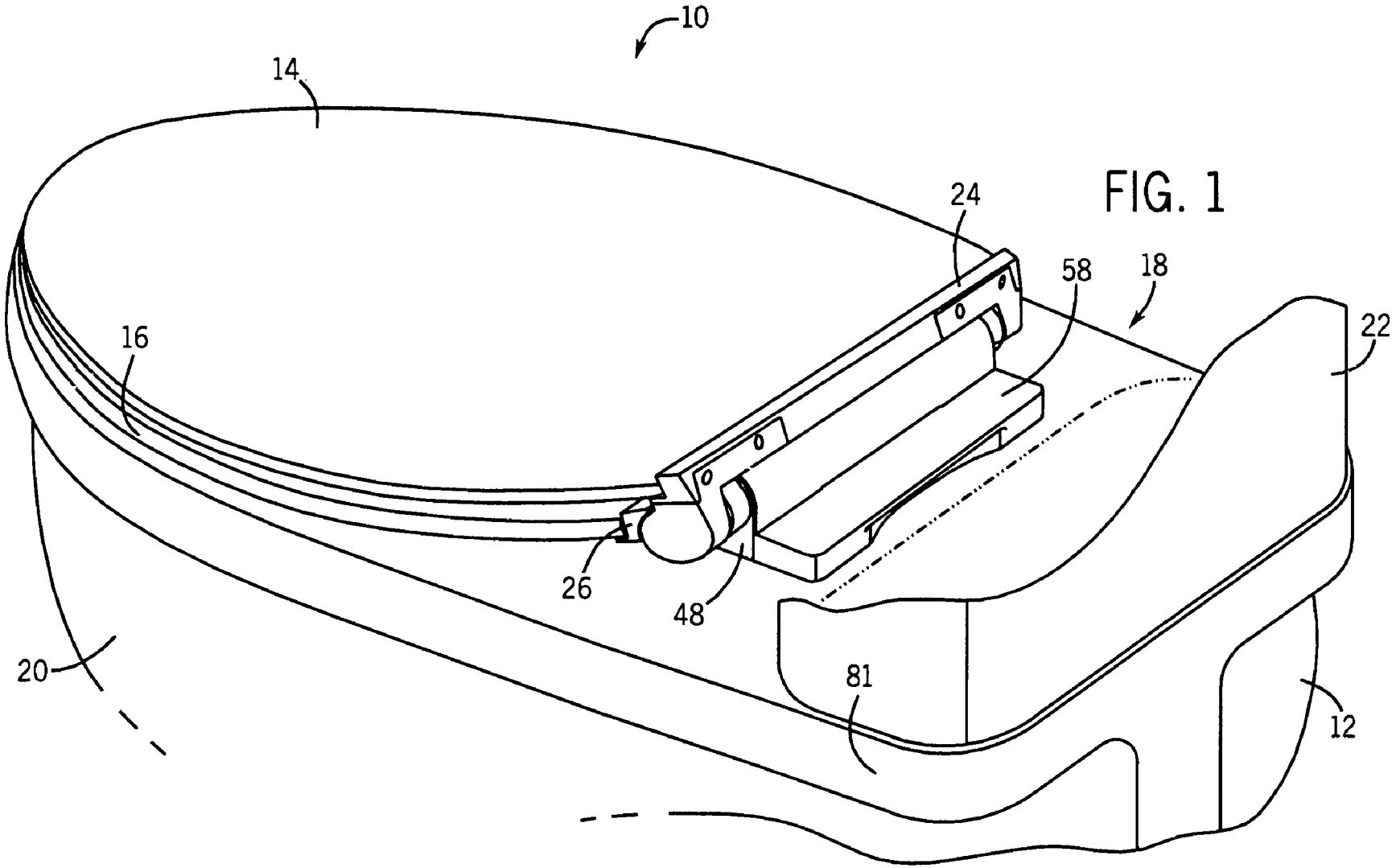
FIG. 1 is a perspective view of a toilet of the present invention on which is mounted a hinge assembly according to the present invention.

Referring first to FIG. 1, there is shown a toilet base 12 linked to a cover 14 and a seat 16. Hinge assembly 18 connects these covering members to the toilet base 12.

Such toilets will likely include other elements such as the usual toilet bowl 20 defining the waste basin, a water storage tank 22, a flush valve (not shown) and other elements (not shown) such as a trap for delivering waste from the bowl 20 to a sewer system. The assembly may also include suitable brackets 24, 26 which connect the cover and seat to associated hinge pins.

Figure 9:
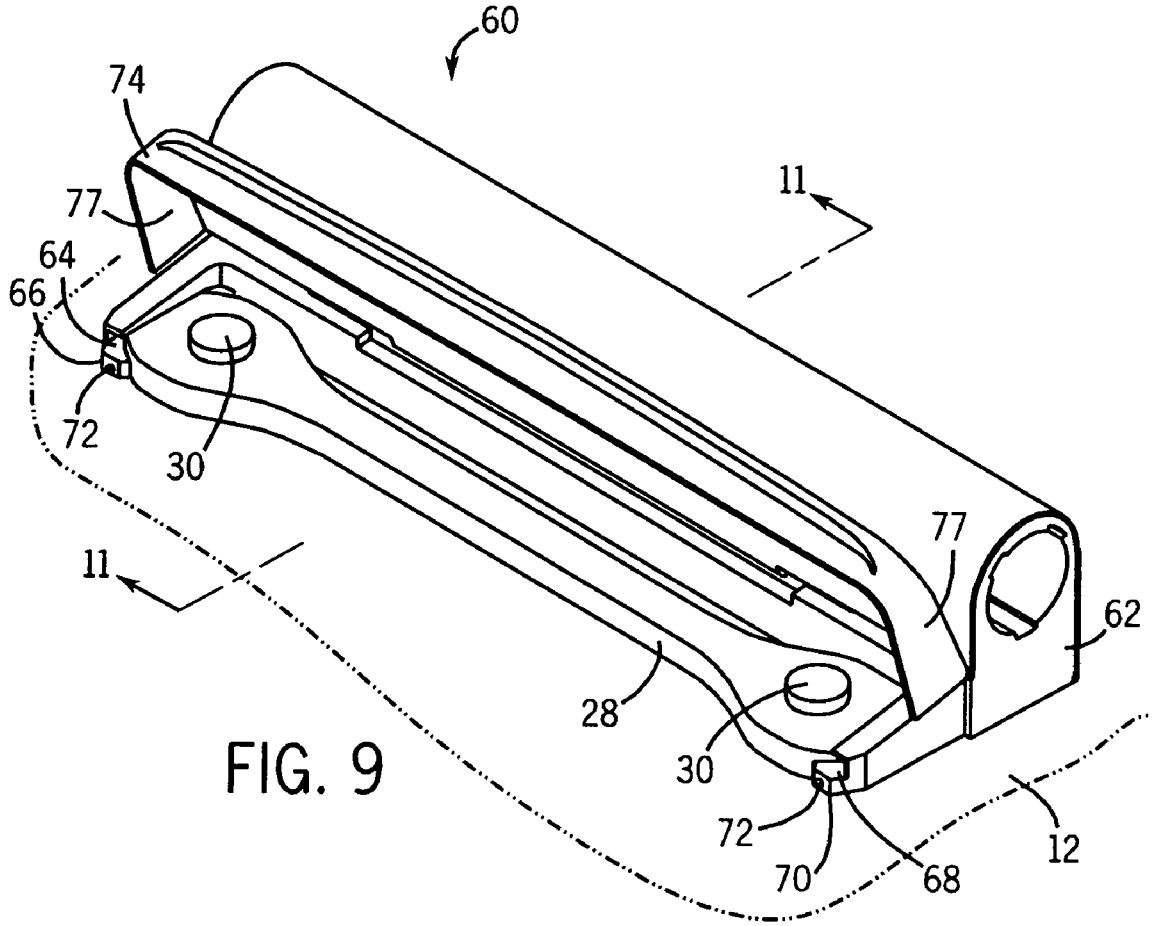
FIG. 9 is a perspective view of an alternative hinge assembly, with its lid position similar to that of the FIG. 3 embodiment.
Figure 10:
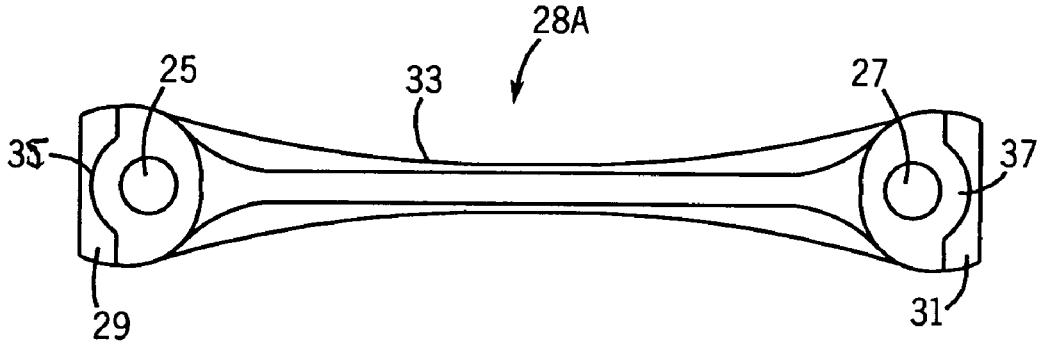
FIG. 10 is a bottom plan view of the mounting plate of the FIG. 9 embodiment.

Referring now more particularly to FIGS. 2-10, there is a bone-shaped mounting plate 28 or 28A clamped down on the rearward extension of the toilet base 12. As best shown in FIG. 10, the plate will have two through holes 25 and 27 and lateral wings 29 and 31. The wings define an undercut region on each lateral side of the mounting plate.

In top view the mounting plate has a narrowed middle 33 and widened regions around holes 25 and 27. Note also that in the FIG. 10 embodiment, but not in the FIG. 2 embodiment, the undercut is formed with laterally projecting bulges 35 and 37.

The mounting plate 28/28A is held onto the rearward extension of the toilet base with bolts 30. These bolts have a widened head and a narrowed cylindrical lower portion which passes through the mounting plate and the rearward extension. The lowest end of the bolts will be conventionally threaded so that corresponding nuts (not shown) can be threaded thereto, optionally with a washer immediately above the nut, on the underside of the rearward extension 81.

Figure 3:
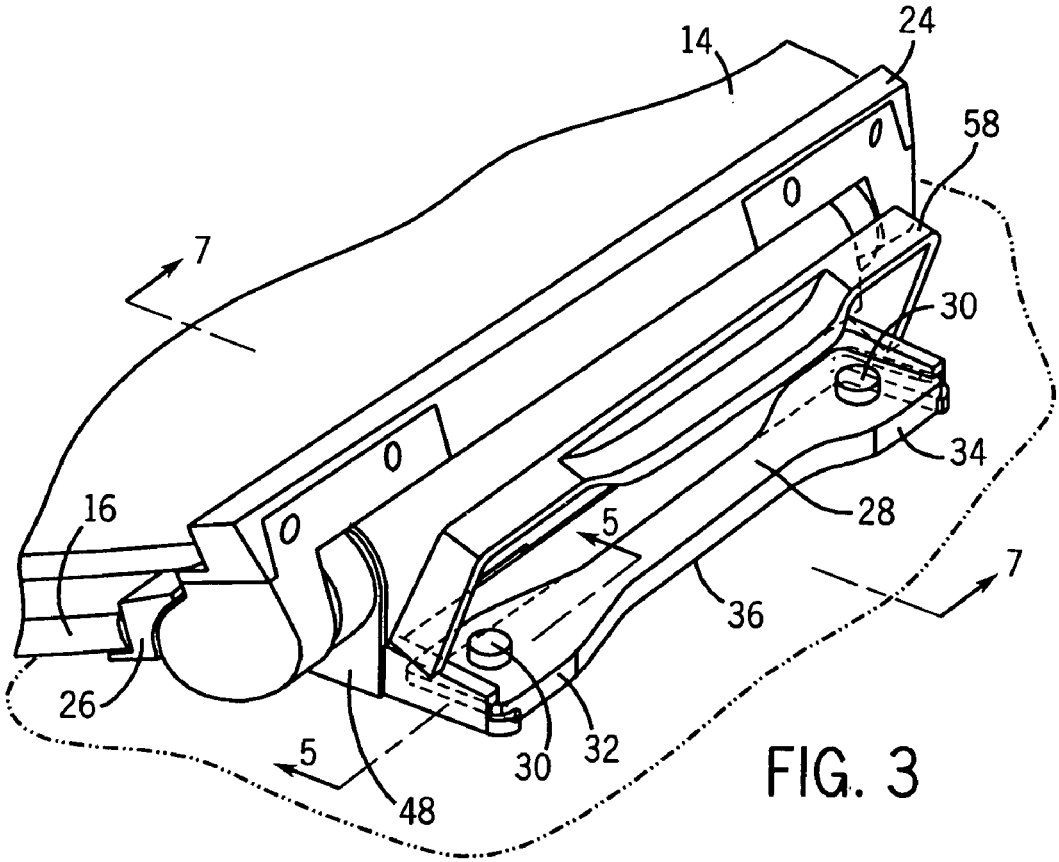
FIG. 3 is a view similar to FIG. 2, but with a lid of the hinge assembly in an open position.
Figure 5:
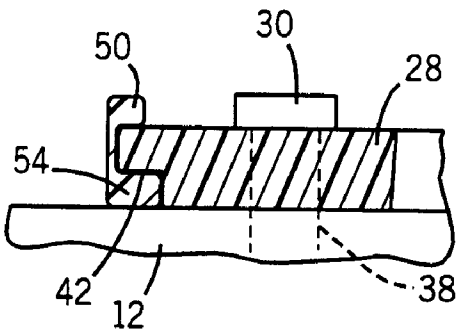
FIG. 5 is cross-sectional view taken along line 5-5 of FIG. 3.
Figure 4:
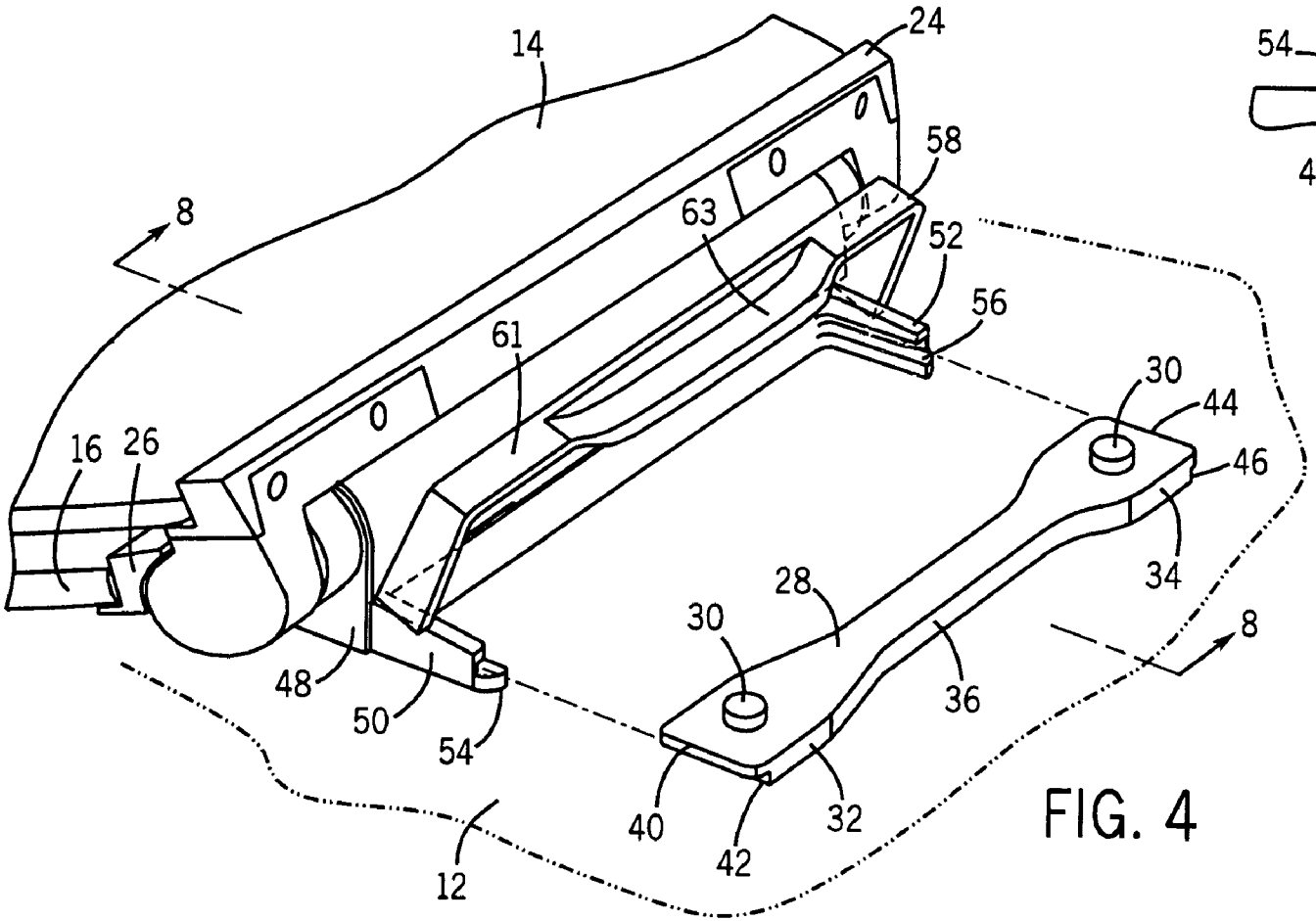
FIG. 4 is a partially exploded perspective view of the FIG. 3 hinge structure.
Figure 15:
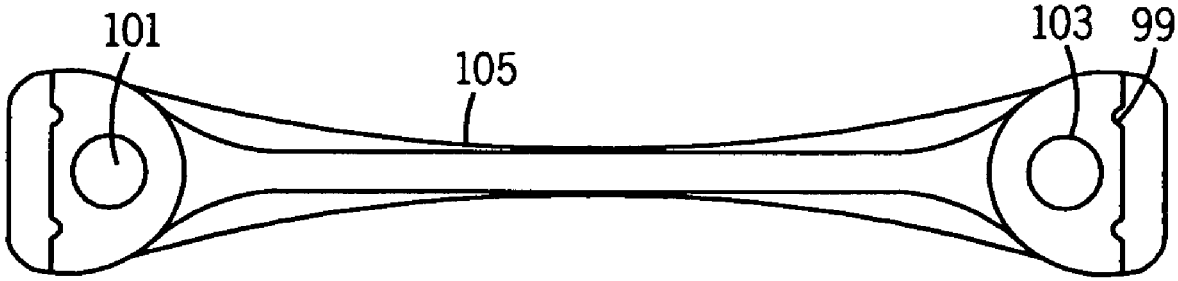
FIG. 15 is a view similar to FIG. 10, but of a mounting plate for a further alternative embodiment.

In the FIG. 3 embodiment the narrowing along the front and rear of the mounting plate 28 is less smoothly contoured than in the FIG. 10 embodiment's plate 28A. However, there is still a narrowed middle 36 and widened lobes 32 and 34. Similarly, as shown in FIG. 4 there are wings 40 and 44 and undercuts 42 and 46. However, as will be appreciated from FIG. 5 (and also analogous portions of FIG. 15) the undercuts are not interrupted by bulges.

A hinge base member 48 includes a first arm 50 and a second arm 52 defining an opening therebetween for receiving the mounting plate 28. First arm 50 has an inwardly projecting ledge 54 following it on its inward side. Similarly, second arm 52 has a ledge 56 along its inward side. Wings 40 and 44 can rest on ledges 54 and 56.

Figure 6:
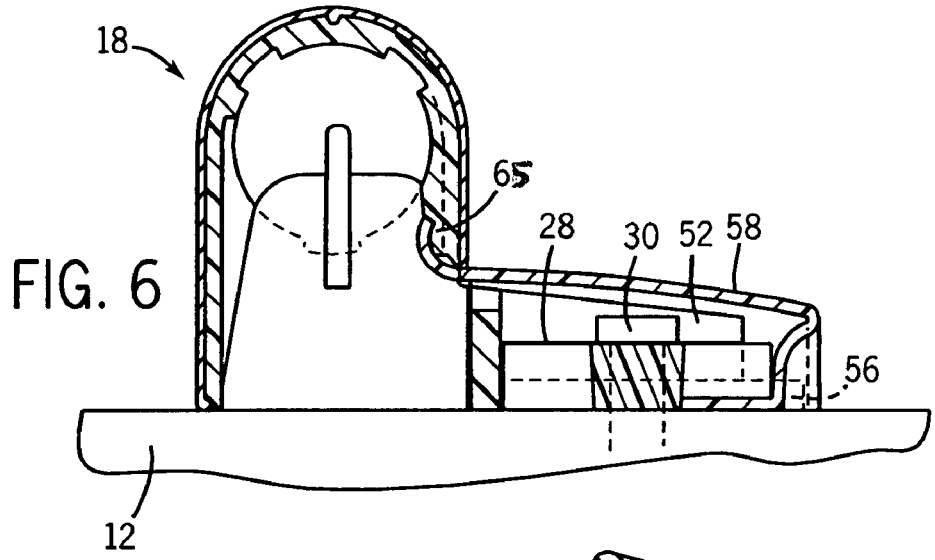
FIG. 6 is cross-sectional view taken along line 6-6 of FIG. 2.
Figure 7:
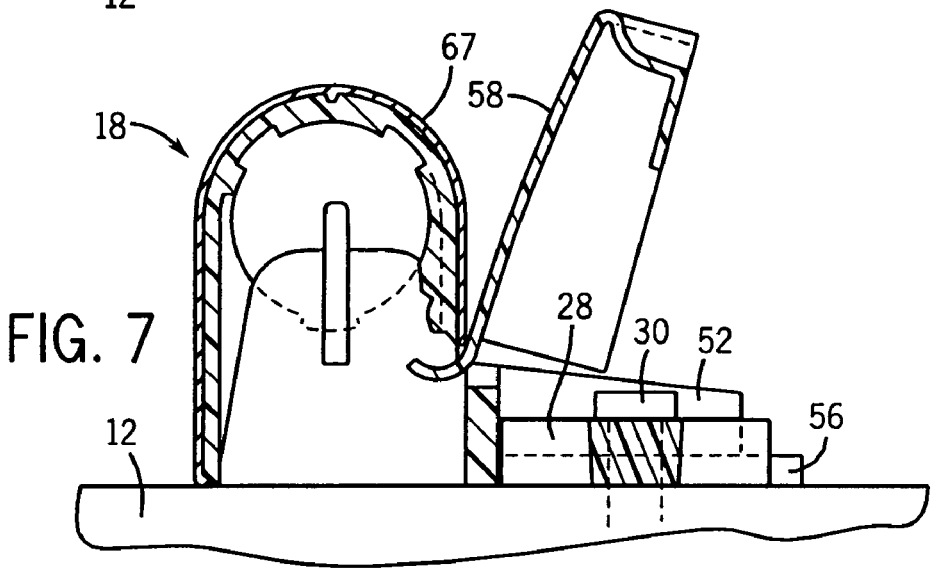
FIG. 7 is cross-sectional view taken along line 7-7 of FIG. 3.
Figure 8:
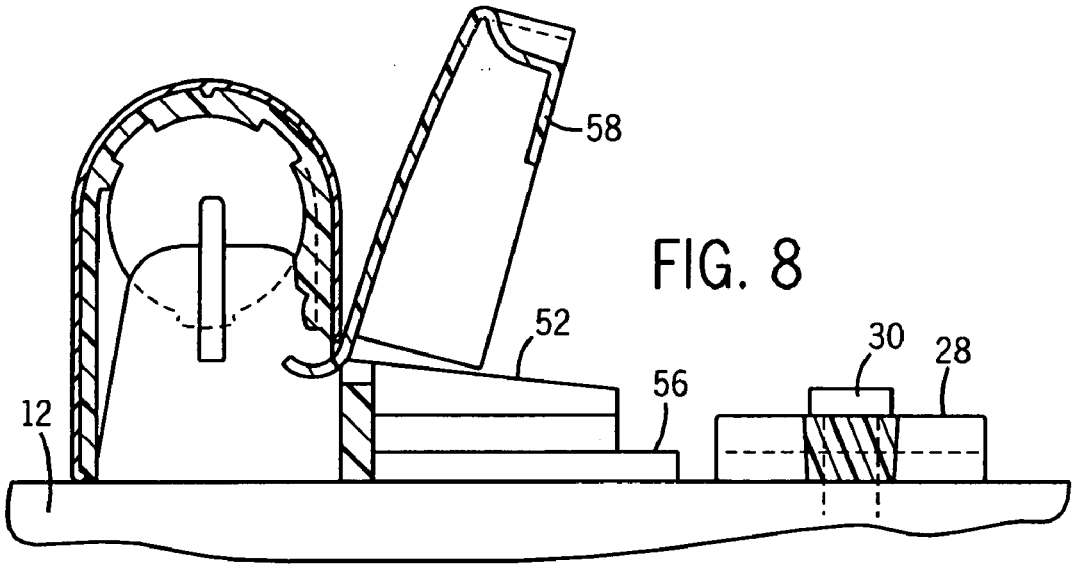
FIG. 8 is cross-sectional view taken along line 8-8 of FIG. 4.

A pivotable lid 58 is connected to the hinge base member 48 to pivot on a horizontal axis from a first position as shown in FIG. 6 to a second position as shown in FIG. 7. The lid has a rearward wall 61 with a forwardly dished region 63 to facilitate a finger being able to lift the lid. The lid also has a rearward projection 65 which hooks between a metallic shield 67 and the remaining plastic portion of the hinge base member. If desired, dished region 63 could be designed to dish in so far as to abut against a rearward portion of the mounting plate 28 (see FIG. 6) to inhibit upward movement of the lid.

When the lid 58 is in an open position (FIGS. 3, 4, 7 and 8), cover 14, seat 16, their respective brackets 24, 26, the hinge base member 48, and the lid 58, can easily be slid back as a unit from the FIG. 4 position to the FIG. 3 position. This restricts upward movement of this hinge base member 48.

Figure 2:
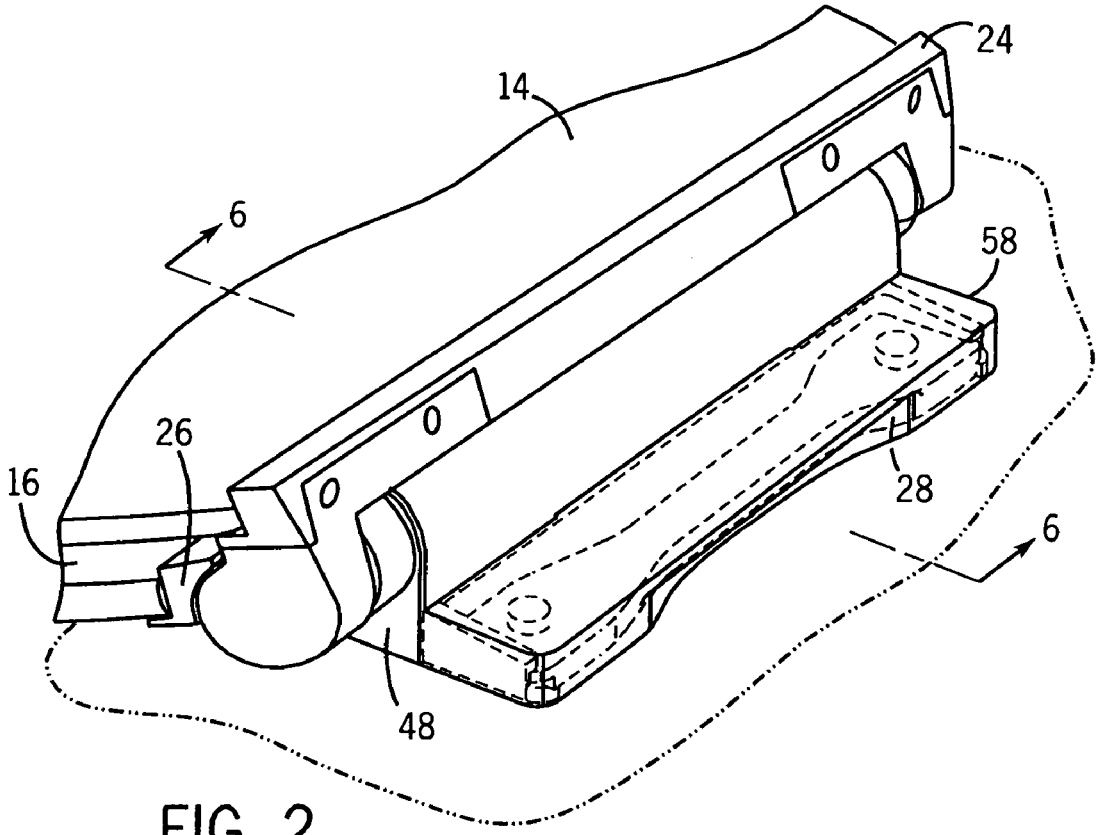
FIG. 2 is an enlarged perspective view of a hinge portion thereof.

Then, the lid can be pivoted down to the FIG. 2 position. This restricts forward movement of the hinge base member 48. If the lid 58 is made of the same decorative material as the metallic shield 67 this will then create a highly decorative metallic outer appearance, and in any event present a hinge which appears to the consumer to be durable.

Figure 11:
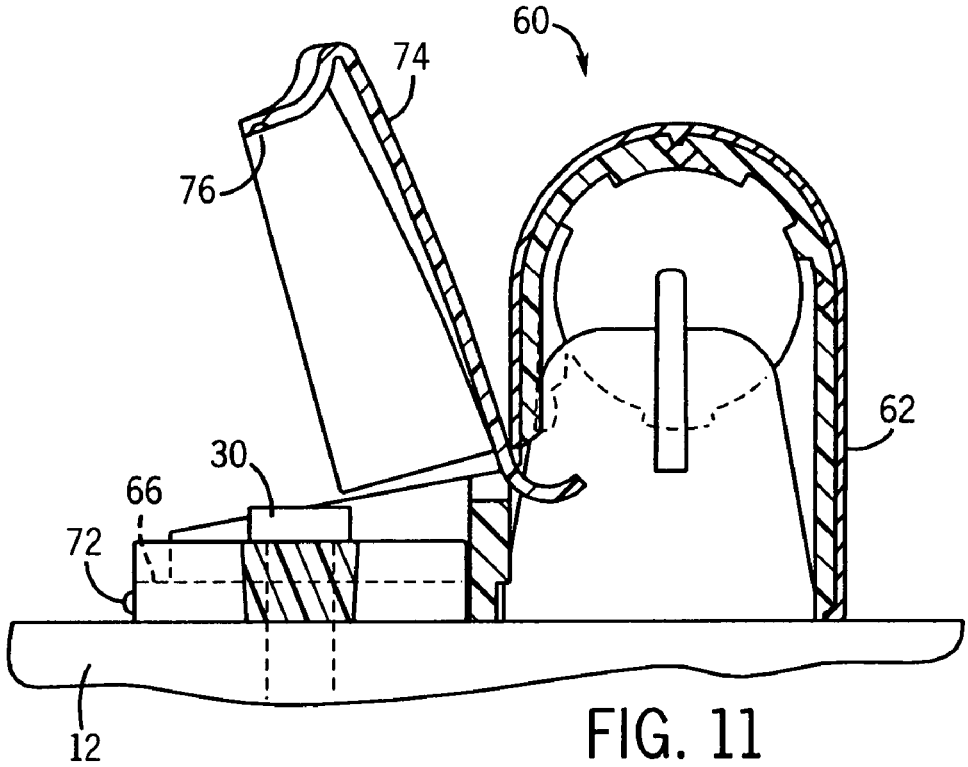
FIG. 11 is cross-sectional view taken along line 11-11 in FIG. 10.

An alternative embodiment is shown in FIGS. 9-11. Its structure is very similar to the FIG. 1 embodiment except for the hinge arms now having a snap interlock with the lid, and the arms being laterally flexible and having catch fingers which interact with the FIG. 10 bulges 35, 37.

Assembly 60 includes a hinge base member 62 having an arm 66 formed with ledge 64. There is also an arm 70 having a ledge 68. which has a first arm 66 extending therefrom. Second ledge 68 has a second arm 70 extending therefrom.

There are now rearward bead-like projections 72 which can catch in a corresponding pocket 76 of the lid, in a snap fit manner, to further retard upward movement of the lid.

Also, the rearward ends of the arms 66 and 70 are now in the form of curled fingers which "caress" bulges 35 and 37 when the FIG. 9 position is reached. As these fingers are pushed back along the bulges 35 and 37 they first flex outwardly and then snap back inwardly to help trap the hinge base member on the mounting plate. Lowering the lid to the closed position causes the sides 77 of the lid 74 to prevent outward flexing of the arms, thereby locking the assembly.

Figure 12:
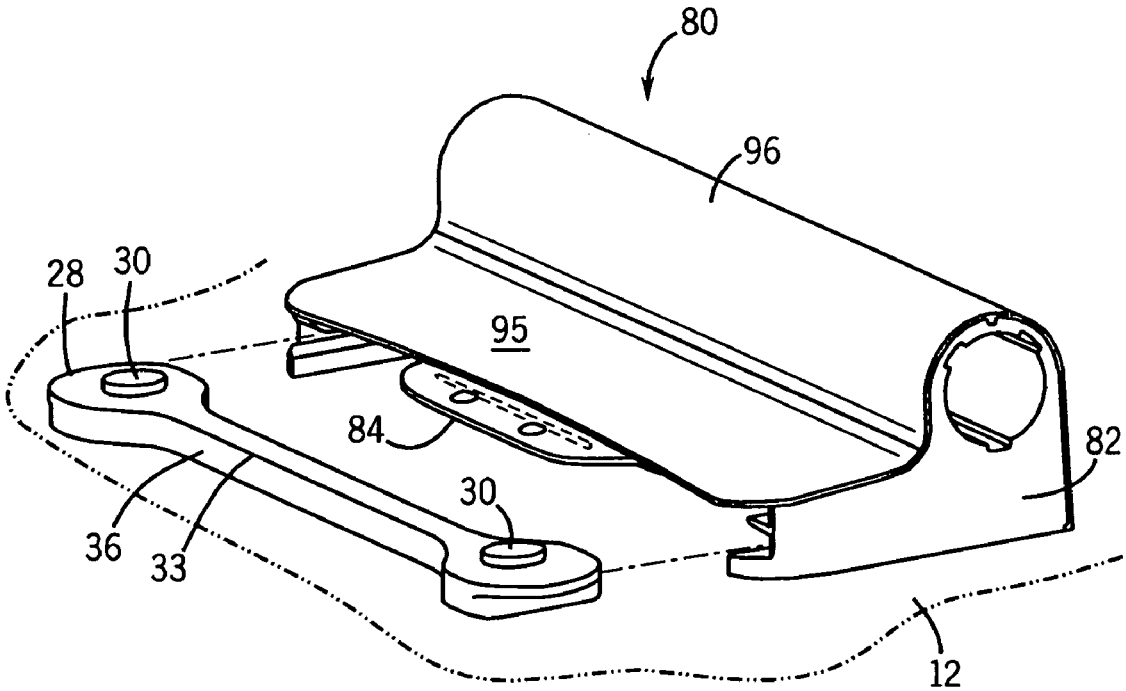
FIG. 12 is an exploded perspective view of another embodiment.
Figure 13:
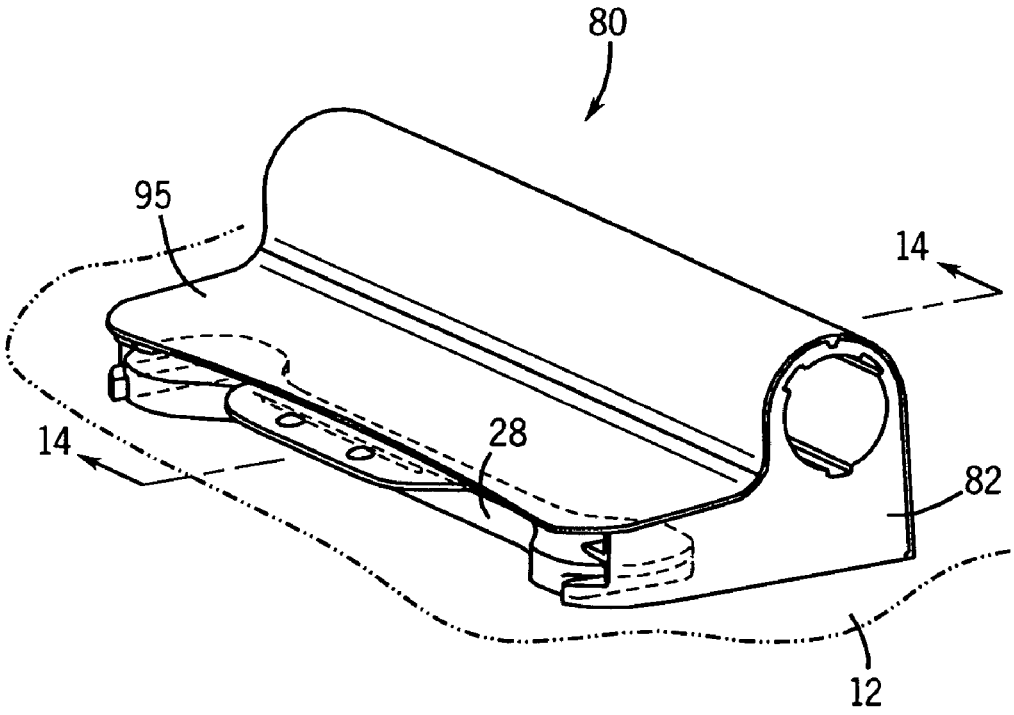
FIG. 13 is a view thereof similar to FIG. 12, but showing its mounting plate engaged by a lid.
Figure 14:
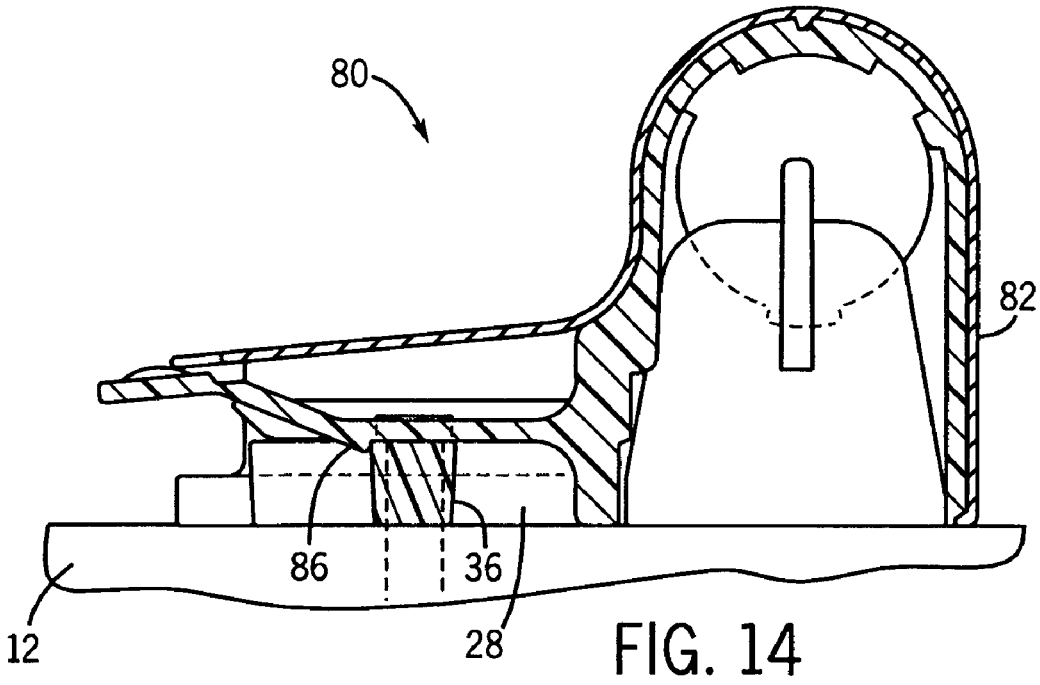
FIG. 14 is a cross-sectional view taken along line 13-13 of FIG. 13.

In another alternative embodiment of FIGS. 12-14, the lid 95 is integral with the shield 96. Yet, it is still somewhat pivotable as will be described below.

There is an assembly 80 having a hinge base member 82. A rearward portion of the lid 95 is in the form of a flexible tab 84 which in a rest position catches behind middle 33 of the mounting plate 28. To disassemble the parts, one lifts up the tab 84 so that it is above the plate 28. The base member 82 can then be slid forward. Reversing the motion causes the tab 84 to be driven up by contact with the mounting plate until it passes behind and snaps behind the middle 33.

Hence, the invention achieves the desired advantages of facilitating cleaning and maintenance. A consumer can install and/or remove most of the seat assembly once the mounting plate has been permanently installed.

Because a single plate anchored at two ends facilitates connection for both hinge ends, the part is secure and durable. Further, the parts of the assembly are inexpensive to manufacture and intuitive to use.

While several embodiments have been described and disclosed, it will be apparent to those skilled in the art that other changes can be made as well. Another example is exemplified by FIG. 15. In this embodiment, a mounting plate having openings 101 and 103 for receiving fasteners and narrowed middle 105 is instead provided with at least two (one on each side), and preferably four pockets 99. The inner arms 50 and 52 of the FIG. 4 embodiment could be provided with inwardly projecting beads (similar to beads 72 of FIG. 9, but facing towards the other arm). As the arms slide along the mounting plate, these beads could snap into pockets 99, providing further resistance to forward movement of the hinge base member 48.

Therefore, the present invention is not to be limited to just the described most preferred embodiments. Hence, to ascertain the full scope of the invention, the claims which follow should also be referenced.

INDUSTRIAL APPLICABILITY

The present invention provides a mounting assembly suitable to attach a toilet seat and/or cover to a toilet base, and/or toilets with such seat assemblies installed thereon.

What is claimed is:

1. A hinge assembly for connecting a covering member to a toilet base, the toilet base being of a type having two spaced apart mounting holes on an upper rearward surface of the toilet base, the hinge assembly comprising:

a mounting plate mountable on an upper rearward surface of the toilet base, and having two spaced apart through holes and two lateral wings, wherein said mounting plate is sufficiently elongated to extend over both of said mounting holes, and wherein each of said lateral wings further comprises an undercut;

fasteners extendible through the through holes and then into the mounting holes to mount the mounting plate thereon;

a hinge base member adapted to support the covering member in a pivotal fashion, the hinge base member having a pair of essentially horizontally extending extension arms defining in part an opening for receiving the mounting plate therebetween, wherein each of said arms has an inwardly projecting ledge disposed on its inward side; and a lid pivotably mounted on the hinge base member to pivot relative to the hinge base member between a first position where a rearward portion of the lid is positioned behind a portion of the mounting plate and a second position where it is not;

wherein when said lateral wings of the mounting plate are slid into engagement with said hinge base member the arms of the hinge base member are located under said undercuts of said lateral wings such that the lateral wings of the mounting plate are located above said ledges of said arms and the hinge base member is thereby restricted from upward movement relative to the mounting plate;

wherein accommodation of the mounting plate between said arms of the hinge base member is facilitated due to arm lateral flexibility; and wherein when the lid is in the first position it restricts forward movement of the hinge base member relative to the mounting plate.

2. The hinge assembly of claim 1, wherein there is a recess on at least one of the hinge base member and lid, and a projection on the other of the hinge base member and lid, such that as the lid pivots toward the first position the projection snaps into the recess to help inhibit movement of the lid from the first position.

3. The hinge assembly of claim 2, wherein the recess is on the lid, and the projection is adjacent a rearward portion of a hinge base member arm.

4. The hinge assembly of claim 1, wherein there is a recess on at least one of the hinge base member and mounting plate, and a projection on the other of the hinge base member and mounting plate, such that as the arms of the hinge base member slide under the wings of the mounting plate the projection can snap into the recess to help inhibit forward movement of the hinge base member relative to the mounting plate.

5. The hinge assembly of claim 4, wherein the recess is on the mounting plate and the projection is formed along a lateral surface of a hinge base arm.

6. The hinge assembly of claim 1, wherein a portion of the hinge base member is formed of plastic, a metallic decorative shield is positioned over that plastic portion, and the lid has a metal upper surface, whereby the hinge assembly, when installed on a toilet base, presents an essentially decorative metallic outer appearance.

7. The hinge assembly of claim 6, wherein a frontal portion of the lid is formed with extensions that can hook between the metallic decorative shield and the plastic portion of the hinge base member.

8. The hinge assembly of claim 1, wherein the mounting plate has a narrow central section and wider side lobes.

9. The hinge assembly of claim 8, wherein the lid is formed with a rearward end that has a forwardly dished recess for facilitating gripping the lid.

10. The hinge assembly of claim 1, wherein both of the arms of the hinge base member are capable of flexing away from each other.

11. The hinge assembly of claim 10, wherein rearward portions of the arms of the hinge base member are both formed with a contoured catch finger.

12. The hinge assembly of claim 11, wherein the mounting plate is formed with a laterally directed bulge under each wing on which a catch finger can slide against and catch behind.

13. The hinge assembly of claim 1, wherein the covering member is selected from the group consisting of a pivotable toilet seat and a pivotable toilet seat cover.

14. A toilet assembly, comprising:

a toilet base having two spaced apart mounting holes on its upper rearward surface;

a covering member; and a hinge assembly connecting the covering member to the toilet base, the hinge assembly comprising:

a mounting plate mounted on the upper rearward surface of the toilet base and having two spaced apart through holes and two lateral wings, wherein said mounting plate is sufficiently elongated to extend over both of said mounting holes, and wherein each of said lateral wings further comprises an undercut;

fasteners extended through the through holes and then into the mounting holes to mount the mounting plate thereon;

a hinge base member supporting the covering member in a pivotal fashion, the hinge base member having a pair of essentially horizontally extending extension arms defining in part an opening receiving the mounting plate therebetween, wherein each of said arms has an inwardly projecting ledge disposed on its inward side; and a lid pivotably mounted on the hinge base member to pivot relative to the hinge base member between a first position where a rearward portion of the lid is positioned behind a portion of the mounting plate and a second position where it is not;

wherein when said wings of the mounting plate are slid into engagement with said hinge base member the arms of the hinge base member are located under said undercuts of said lateral wings such that the lateral wings of the mounting plate are located above said ledges of said arms and the upper rearward surface of said toilet base restricts upward movement of the hinge base member relative to the upper rearward surface of the toilet base;

wherein the mounting plate is accommodated between said arms of the hinge base member due to arm lateral flexibility; and wherein when the lid is in the first position it restricts forward movement of the hinge base member relative to the mounting plate.

* * * * *